US008399807B2

(12) United States Patent
Abe

(10) Patent No.: US 8,399,807 B2
(45) Date of Patent: Mar. 19, 2013

(54) GLOW PLUG AND METHOD FOR MANUFACTURING THE SAME

(75) Inventor: Haruhiko Abe, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 658 days.

(21) Appl. No.: 12/449,937

(22) PCT Filed: Feb. 19, 2008

(86) PCT No.: PCT/JP2008/052692

§ 371 (c)(1),
(2), (4) Date: Jan. 12, 2010

(87) PCT Pub. No.: WO2008/108161

PCT Pub. Date: Sep. 12, 2008

(65) Prior Publication Data

US 2010/0133252 A1 Jun. 3, 2010

(30) Foreign Application Priority Data

Mar. 8, 2007 (JP) ..... 2007-057976
Dec. 13, 2007 (JP) ..... 2007-321571

(51) Int. Cl.
*F23Q 7/22* (2006.01)
*F23Q 7/00* (2006.01)

(52) U.S. Cl. ..... 219/270; 219/266; 219/267

(58) Field of Classification Search ..... 219/266, 219/267, 270
See application file for complete search history.

(56) References Cited

U.S. PATENT DOCUMENTS

| | | | | |
|---|---|---|---|---|
| 4,477,717 | A * | 10/1984 | Walton | 219/267 |
| 6,979,801 | B2 * | 12/2005 | Okazaki et al. | 219/270 |
| 2004/0222207 | A1 * | 11/2004 | Kumada | 219/270 |
| 2007/0289960 | A1 * | 12/2007 | Tanaka et al. | 219/383 |

FOREIGN PATENT DOCUMENTS

| | | |
|---|---|---|
| JP | 54-111527 | 8/1979 |
| JP | 51-82648 | 5/1982 |
| JP | 60-176356 | 11/1985 |
| JP | 03-091614 | 4/1991 |
| JP | 11-294768 | 10/1999 |
| JP | 2004-340562 | 12/2004 |

OTHER PUBLICATIONS

International Search Report for International Application No. PCT/JP2008/052692, Feb. 19, 2008.

* cited by examiner

*Primary Examiner* — James Mitchell
(74) *Attorney, Agent, or Firm* — Kusner & Jaffe

(57) ABSTRACT

The present invention provides a glow plug capable of preventing a deformation or eccentricity of the coil, thereby improving a durability of the coil and preventing a variation in temperature-rising characteristic. Also, the present invention provides a method for manufacturing the glow plug.

7 Claims, 8 Drawing Sheets

GLOW PLUG AND METHOD FOR MANUFACTURING THE SAME

FIELD OF THE INVENTION

The present invention relates to a glow plug used for preheating a diesel engine or the like, and to a method for manufacturing the same.

BACKGROUND OF THE INVENTION

A conventional glow plug used for preheating a diesel engine or the like is comprised of a metal sheath tube having a closed front end. A sheath heater is accommodated in the sheath tube together with a coil, used as a heating element, and insulating powder.

A front end portion of the coil disposed in the sheath tube is joined to the front end of the sheath tube, and a rear end portion of the coil is joined to a front end of a conductive terminal axis that is inserted in the sheath tube rear portion. The coil is energizable through the conductive terminal axis.

The above-mentioned sheath heater is generally manufactured as follows. First, a front end of a cylindrical tube is made in a tapered shape. The coil is then connected to the front end of the conductive terminal axis is disposed in the tube. Thereafter, one end of the coil is welded to the front end portion of the tube, and the front end portion of the tube is closed. Then, insulating powder, such as magnesia, is filled in the tube, and a sealing is provided between the rear end of the tube and the conductive terminal axis so as to seal the tube. Thereafter, the sheath tube is subjected to a swaging step. The thus-produced sheath heater is assembled into a metal shell with a projecting manner to complete the glow plug.

However, since the coil is relatively soft, it may bend or become eccentric during the swaging step. In some cases, a winding pitch of the coil becomes inconsistent. When the coil is greatly bent, the sheath tube and the coil are likely to be in contact each other, causing a short-circuit at the time of energization. As a result, the coil cannot reach at a predetermined temperature. Further, there is also the possibility that the glow plug has a large variation in temperature-rising characteristic of the heater due to inconsistency of the winding pitch of the coil.

Thus, the conventional technology shows that a rod-like insulator is inserted in the coil prior to the swaging step so as to increase density in the sheath tube and prevent the above-mentioned failure (e.g., Japanese Patent Application Laid-Open (kokai) No. 2004-340562).

However, as in a sheath heater 50 shown in FIG. 9, when a rod like insulator 51 having a small diameter is inserted in a coil 52, the coil tends to be greatly bent because a clearance between the insulator 51 and an inner circumference of the coil 52 is relatively large. Therefore, an insulator 61 with a relatively large diameter is preferably employed so that the clearance with the inner circumference of the coil 52 may be reduced, as shown in FIG. 10.

However, as shown in FIG. 10, the diameter of the front end portion of the coil 52 is tapered so as not to contact with a front end side tapered portion 53*a* of a sheath tube 53. Therefore, if an insulator 61 having a large diameter is employed, and the coil 52 is bent in a small degree, the insulator 61 cannot reach a front end of a taper-shaped reduced diameter portion 52*a* of the coil 52. In this case, only insulating powder fills the vicinity of the front end portion of the coil 52, and density in the vicinity of the front end portion becomes relatively low. As a result, when the front end portion of the coil 52 is subjected to the swaging step, the coil 52 is likely to deform locally or to have an inconsistent thickness in the vicinity where the insulator 61 is not inserted in coil 52. This is because the sheath tube deforms in the swaging step, and an impact (i.e., force) is exerted on the coil as a result of movement of the insulating powder due to the deformation during the swaging step. If the coil is greatly deformed at a particular location, the thickness of the coil may become inconsistent at that location. Particularly, resistance in a thin portion of the coil becomes large. As a result, the coil tends to heat up at locations of deformation, causing a disconnection (failure) at an early stage.

An object of the present invention is to overcome the above-mentioned problems and to provide a glow plug capable of preventing a deformation or eccentricity of the coil, improving durability and reducing a variation in temperature-rising characteristic.

Another object of the present invention is to provide a method for manufacturing the glow plug.

SUMMARY OF THE INVENTION

Next, in order to solve the above-mentioned problems, suitable compositions according to the present invention will be described in the following paragraphs. Effects of the present invention will be described in a corresponding discussion, if necessary.

According to a First aspect of the present invention, there is provided a glow plug, comprising: an axially extending cylindrical sheath tube including a closed front end and a front end reduced diameter portion that is tapered toward the front end; a coil made of a resistance wire, disposed along the axis of the sheath tube and joined to a front end of the sheath tube; a rod-like insulator inserted in the coil, and insulating powder filled in the sheath tube, wherein the coil has a taper-shaped, reduced-diameter portion disposed in the front end reduced diameter portion of the sheath tube, and wherein the insulator has a thin diameter portion inserted in the taper-shaped reduced diameter portion of the coil.

According to the First aspect, since the reduced diameter portion of the insulator is formed in the front end portion of the insulator, the insulator can reach a forward position of the taper-shaped reduced diameter portion of the coil. As a result, the inconsistent deformation of the coil can be prevented during the swaging step, thereby preventing a disconnection at an early stage.

According to a Second aspect of the present invention, there is provided a glow plug, comprising: an axially extending cylindrical sheath tube including a closed front end; a coil made of a resistance wire, disposed along the axis of the sheath tube and joined to a front end of the sheath tube; and insulating powder filled in the sheath tube, wherein the glow plug is formed through a swaging step, wherein a rod-like insulator made of an insulating material is inserted in the coil prior to the swaging step, wherein a thin portion having a diameter smaller than an outer diameter of a general portion of the insulator is formed on the front end side of the insulator and is inserted into a taper-shaped reduced diameter portion formed at the front end side of the coil at the time of conducting the swaging step, and wherein a front end portion of the insulator is disposed at a front edge position in a predetermined section in the axial direction where the swaging step is conducted, or a further forward position with respect to the front edge position.

According to the Second aspect, since the thin portion of the insulator is formed in the front end side of the insulator, the insulator can reach a further forward position of the taper-shaped reduced diameter portion of the coil. Since the insulator is disposed at the front end position in the predetermined section in the axial direction where the swaging step is conducted or at a further forward position with respect to the predetermined section, the inconsistent deformation of the coil is unlikely to occur during the swaging step, thereby preventing a disconnection at an early stage.

In addition to the First or Second aspect, a glow plug according to a Third aspect of the present invention satisfies an expression: $0 \leqq B \leqq 1$ mm, where a distance between a front end inner face of the sheath tube and a front end portion of the insulator is set to be "B" with respect to the axial direction.

According to the Third aspect, the insulator is inserted in the sheath tube so as to be in contact with the front end inner face of the sheath tube or so as to be closer to the front end inner face thereof, thereby assuredly realizing the effects (benefits) of the First and Second aspects.

In addition to any one of the First to Third aspects, a glow plug according to a Fourth aspect of the present invention satisfies an expression: $0.4 \text{ mm} \leqq Dx \leqq 1.1$ mm, where a difference between an inner diameter of the general portion of the sheath tube and an outer diameter of the general portion of the coil is set to be Dx, and the glow plug further satisfies an expression: $Cx \leqq 0.3 \times Dx$, where a difference between the inner diameter of the general portion of the coil and the outer diameter of the general portion of the insulator is set to be Cx.

When the clearance between the inner circumferential portion of the general portion of the sheath tube and the outer circumferential portion of the general portion of the coil is too small, they are likely to be in contact with each other due to manufacture variations or the like at the time of welding or the swaging step, resulting in a short-circuit. In order to prevent such a problem, the difference Dx is preferably 0.4 mm or more after the swaging step. On the other hand, when the clearance between the inner circumferential portion of the general portion of the sheath tube and the outer circumferential portion of the general portion of the coil is too large, the surface temperature of the tube is unlikely to rise, causing an impact on the temperature-rising characteristic of the heater. In order to prevent this problem, the difference Dx is preferably 1.1 mm or less after the swaging step. Each general portion of the sheath tube, the coil and the insulator means a portion having a uniform diameter, respectively, in the axial direction.

Since the insulator is inserted in the coil, the coil is unlikely to have failures, such as a collapsing under its own weight, not only during the swaging step, but also at the time the coil is inserted into the tube prior to the swaging step, or when the coil is welded at the front end of the tube. Thus, the coil is unlikely to have an eccentricity or a bent. Therefore, short-circuiting between the sheath tube and the coil can be reduced. Such effects are applied to a glow plug having a coil with a small diameter, and the effects are further enhanced when the expression $Cx \leqq 0.3 \times Dx$ is satisfied.

In addition to any one of the First to Fourth aspects, a glow plug according to a Fifth aspect of the present invention is provided, wherein the thin portion of the insulator assumes a taper shape toward the front end portion of the insulator.

According to the Fifth aspect, since the thin portion of the insulator assumes a taper shape and is inserted into the taper-shaped reduced diameter portion formed at the front end side of the coil, the clearance between the outer circumferential portion of the taper portion of the insulator and the inner circumferential portion of the taper-shaped reduced diameter portion of the coil can be made smaller. As a result, the effects of the First and Second aspects can be further realized.

Thus, in order to reduce the clearance between the outer circumferential portion of the taper portion of the insulator and the inner circumferential portion of the taper-shaped reduced diameter portion of the coil, taper angles of both the taper portion and the taper-shaped reduced diameter portion are preferably equal. However, when the taper portion of the insulator is inserted into the taper-shaped reduced diameter portion of the coil, the taper angle of the taper portion of the insulator with respect to the axis is preferably larger than that of the taper-shaped reduced diameter portion of the coil. Because axial misalignment might occur when inserting the insulator into the coil, the front end portion of the insulator might be caught in the middle of the taper-shaped reduced diameter portion of the coil. Thus, there is a possibility that a failure, such as an improper insertion of the insulator, might occur. As a result, manufacturing deviation of the glow plug may not be allowed. That is, unless the manufacturing deviation is very severely controlled, a glow plug with the taper portion of the insulator improperly inserted into the taper-shaped reduced diameter portion of the coil is likely to be produced. Thus, even though the axis of the insulator is misaligned when inserting the insulator into the coil, a glow plug according to the Sixth aspect facilitates the taper portion of the insulator smoothly sliding on the inner circumferential face of the taper-shaped reduced diameter portion of the coil, whereby the insulator is unlikely to stack in (i.e., interfere with) the taper-shaped reduced diameter portion. As a result, the glow plug according to the Sixth aspect can improve workability and a yield of the manufacturing.

In addition to the Fifth aspect, a glow plug according to a Sixth aspect of the present invention satisfies an expression: $\beta \leqq \alpha$, where angle $\alpha$ is the smaller angle of the angles defined by the outer circumferential portion of the taper portion of the insulator and a central axis, and where the angle $\beta$ is the smaller angle of the angles defined by a tangent line, which connects an inner circumferential portion of the taper-shaped reduced diameter portion of the coil and the central axis.

In addition to any one of the First to Sixth aspects, there is provided a glow plug according to a Seventh aspect of the present invention, wherein another thin portion having a diameter equal to the thin portion at the front end side is formed at a rear end side of the insulator.

According to the Seventh aspect, since the same thin portion is formed at both ends of the insulator, a process to confirm an insertion direction of the thin portion of the insulator may be omitted, when inserting the insulator into the coil, thereby improving workability.

A method for manufacturing a glow plug according to the Eighth aspect, comprising: disposing a coil made of a resistance wire along an axis of a cylindrical sheath tube that extends in an axial direction; joining a front end of the coil to a front end portion of the sheath tube while closing the front end of the sheath tube; filling the sheath tube with an insulating powder; and swaging the sheath tube, wherein an insertion step where a rod-like insulator made of an insulating material is inserted in the coil is conducted prior to the swaging step, wherein a thin portion of the insulator, which is formed on the front end side of the insulator and has a diameter smaller than an outer diameter of a general portion of the insulator, is inserted into a taper-shaped reduced diameter portion formed in the vicinity of the front end of the coil in the insertion step, and wherein, in the swaging step, a front edge position in a predetermined section in the axial direction where the swaging step is conducted is disposed at the same position as a front end portion of the insulator or at a rearward position with respect to the front end portion of the insulator.

According to an Eighth aspect of the present invention, even if the insulator is broken into pieces within the tube during the swaging step, impact on the coil is minimized because the insulator is inserted into the coil in the swaging step. Thus, the glow plug having the same effects as the above-mentioned Second aspect can be manufactured with a sufficient yield.

BRIEF DESCRIPTION OF THE DRAWINGS

FIG. 1(*b*) is a longitudinal sectional view of the glow plug;

DETAILED DESCRIPTION OF PREFERRED EMBODIMENTS

Figure 1:
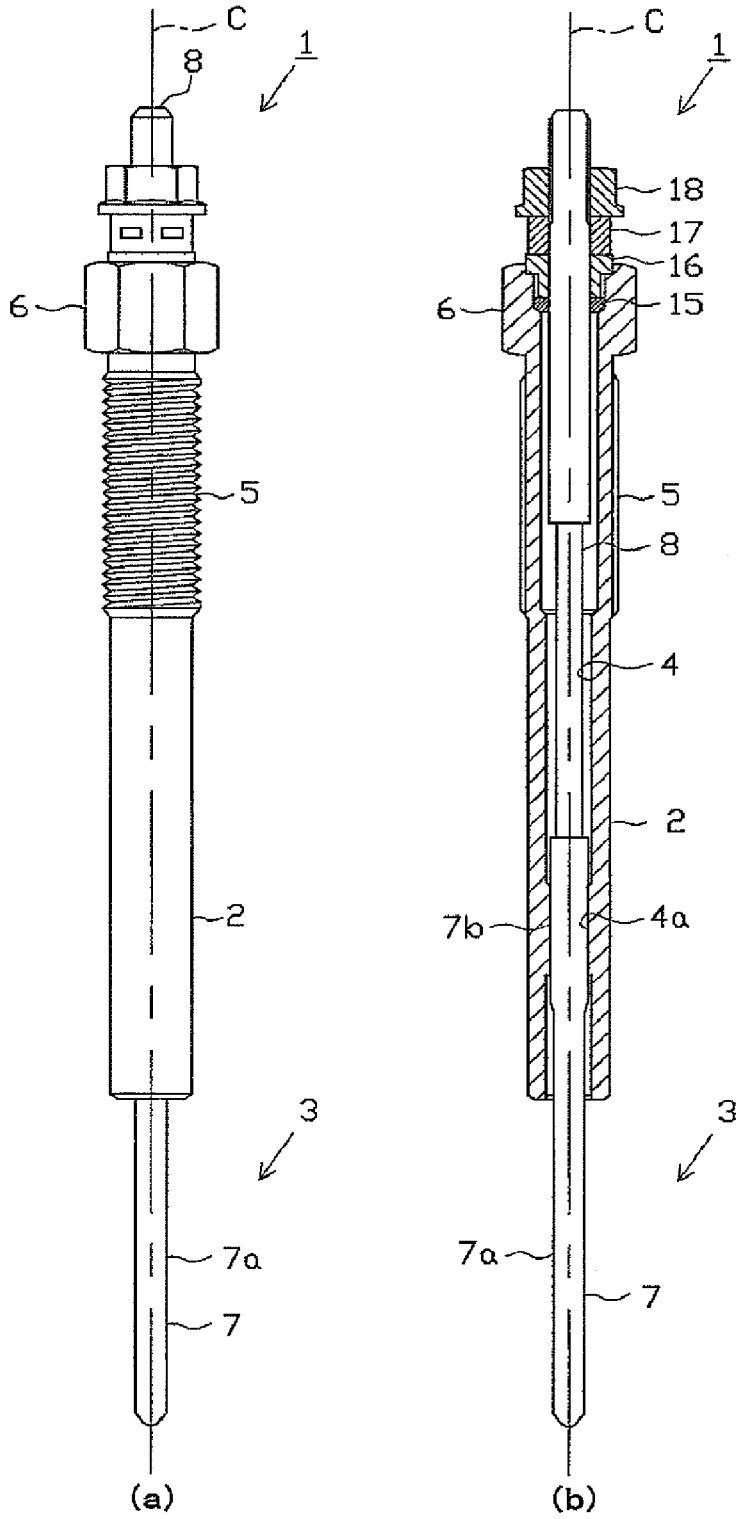
FIG. 1(*a*) is an overall view showing a glow plug according to an embodiment of the present invention.

Hereafter, an embodiment of the present invention will be described with reference to the drawings. FIG. 1(*a*) is an overall view showing a glow plug according to the present invention, and FIG. 1(*b*) is a longitudinal sectional view thereof.

As shown in FIGS. 1(*a*) and (*b*), the glow plug 1 is composed of a cylindrical metal shell 2 and a sheath heater 3 attached to the metal shell 2.

The metal shell 2 has therein an axial bore 4 extending in an axial C direction. A thread portion 5 for attaching to a diesel engine and a tool engagement portion 6 are formed on an outer circumferential face of the metal shell. The tool engagement portion 6 assumes a hexagonal shape in a cross-section for engagement with a tool, such as a torque wrench.

The sheath heater 3 is composed of the sheath tube 7 and a conductive terminal axis 8 which are formed integrally in the axial C direction.

Figure 2:
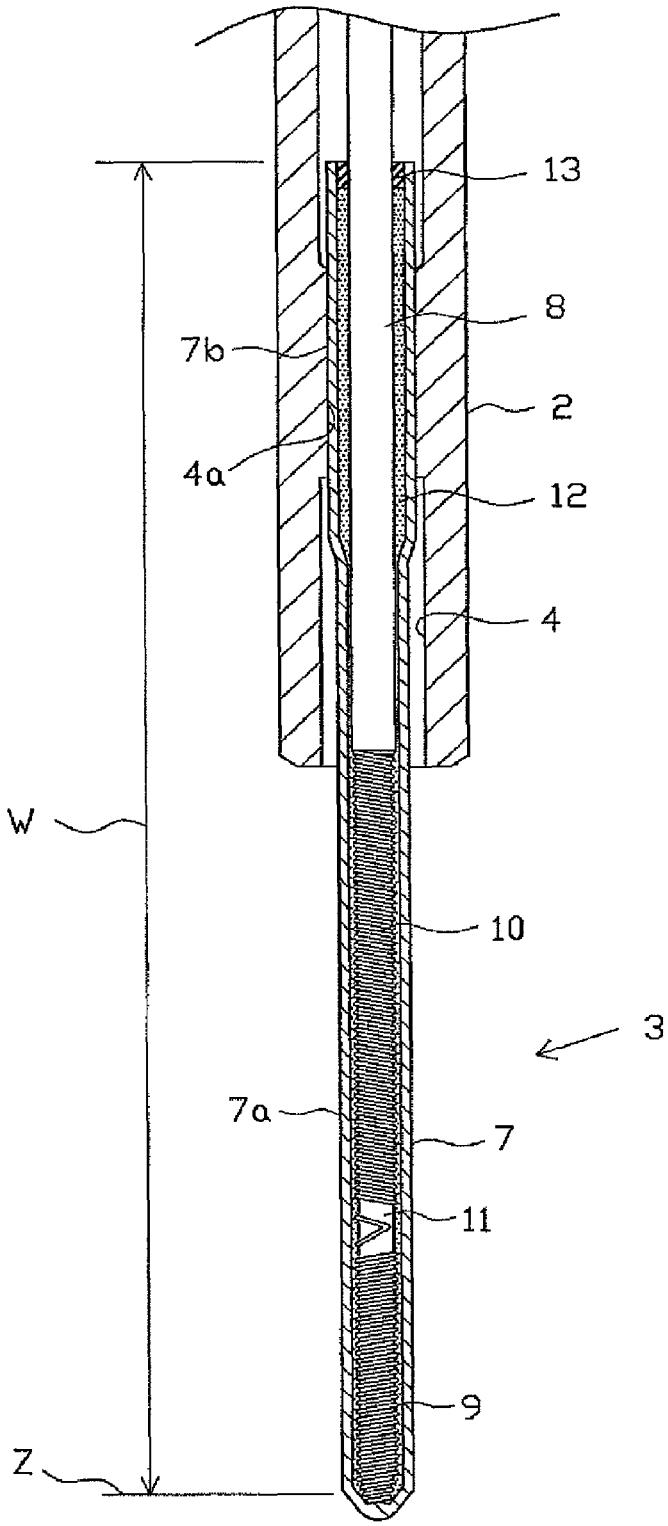
FIG. 2 is a partially enlarged sectional view showing a sheath heater.

As shown in FIG. 2, the sheath tube 7 is a metal tube (e.g., stainless steel) having a closed front end. The sheath tube 7 accommodates therein a heating coil 9 that is joined to the front end of the sheath tube 7 and a control coil 10 that is connected in series to a rear end of the heating coil 9.

Further, in the sheath tube 7, a rod-like insulator 11 made of an insulating material, such as an aluminum oxide (alumina), is inserted in the heating coil 9 and the control coil 10. Insulating powder 12 containing magnesium oxide (magnesia) powder or the like fills space between the insulator 11 and the sheath tube 7. Furthermore, an annular rubber seal 13 is disposed between the rear end of the sheath tube 7 and the conductive terminal axis 8 to seal therebetween. As mentioned above, although the front end of the heating coil 9 is electrically conductive with the sheath tube 7, the outer circumference of the heating coil 9 and that of the control coil 10, and the inner circumference of the sheath tube 7 are insulated by the insulating powder 12. The heating coil 9 and the control coil 10 constitute a coil in this embodiment.

By way of example and not limitation, the heating coil 9 is comprised of a resistance wire, such as a nickel chrome alloy. The control coil 10 is constituted by a resistance wire that is made of a material, such as a cobalt-iron alloy, having a larger temperature coefficient of electric specific resistance than that of the heating coil 9. Thus, the control coil 10 generates heat itself while receiving the heat from the heating coil 9, and increases its electrical resistance, thereby controlling the electric power supply to the heating coil 9. Therefore, at an early stage of energization, the temperature of the control coil 10 is low and the electrical resistance thereof is also small. Thus, relatively large electric power is supplied to the heating coil 9 so as to rapidly raise the temperature. When the temperature of the heating coil 9 rises, the control coil 10 is heated by the heating coil 9, and the electrical resistance of the control coil 10 increases. As a result, the electric power supply to the heating coil 9 decreases. Therefore, after rapidly raising the temperature of the heater at an early stage of the energization, the temperature-rising characteristic of the heater reaches a saturation point by means of the control coil 10 that controls the electric power supply. As a result, excessive rise in the temperature of the coil is unlikely to occur while improving the temperature-rising characteristic of the heater.

Further, the sheath tube 7 is subjected to a swaging step (later described) to form a small diameter portion 7*a* for accommodating the heating coil 9 at the front end side of the sheath tube 7 and to form a large diameter portion 7*b* having a diameter larger than that of the small diameter portion 7*a* at the rear end side of the sheath tube 7. The large diameter portion 7*b* is press-fitted into a small diameter portion 4*a* formed in the axial bore 4 of the metal shell 2 so that the sheath tube 7 projects from the front end of the metal shell 2.

A front end of the conductive terminal axis 8 is inserted into the sheath tube 7 and is electrically connected to the rear end of the control coil 10. The conductive terminal axis 8 is also accommodated in the axial bore 4 of the metal shell 2. The rear end of the conductive terminal axis 8 projects from the rear end of metal shell 2. In the rear end portion of the metal shell 2, a rubber O-ring 15, a resin-made insulating bush 16, a fitting ring 17 for preventing the bush 16 from falling out and a nut 18 used for connecting to a power cable are inserted in the conductive terminal axis 8 in this order.

Next, a method for manufacturing the glow plug 1 will be described. In a manufacturing process of the sheath heater 3, the insulator 11 is first inserted into the heating coil 9 and the control coil 10, both of which are welded together, in an insertion step, and thereafter, the rear end of the control coil 10 is joined to the conductive terminal axis 8 by resistance welding or the like.

In a subsequent disposing step, an open front end of the original-sized cylindrical sheath tube 7 that has a diameter larger than the final size thereof by a processing margin is formed into a taper shape. Then, the heating coil 9 and the control coil 10, having the insulator 11 inserted therein, and the front end of the conductive terminal axis 8 integrated with these coils 9, 10 are disposed in the sheath tube 7.

In a joining step, the front end of the heating coil 9 is joined to the front end portion of the sheath tube 7 by arc welding or the like, and the front end of the sheath tube 7 is closed.

Then, in a filling step, the rear end of the sheath tube 7 is sealed by the annular rubber 13 after the sheath tube 7 is filled with the insulating powder 12. In a subsequent swaging step, the generally whole sheath tube 7 is subjected to the swaging step to be formed into a predetermined size. Then, the sheath heater 3 in which the sheath tube 7 is integrated with the conductive terminal axis 8 is completed.

The thus-produced sheath heater 3 is inserted in the axial bore 4 of the separately formed metal shell 2 from the rear end side of the conductive terminal axis 8. Then, the sheath tube 7 is press-fitted into the axial bore 4 so that the sheath tube 7 projects from the front end of metal shell 2. Next, the above-mentioned O-ring 15 is inserted into the rear end portion of the conductive terminal axis 8 that projects from the rear end portion of the metal shell 2. In this way, the glow plug 1 is completed.

Figure 3:
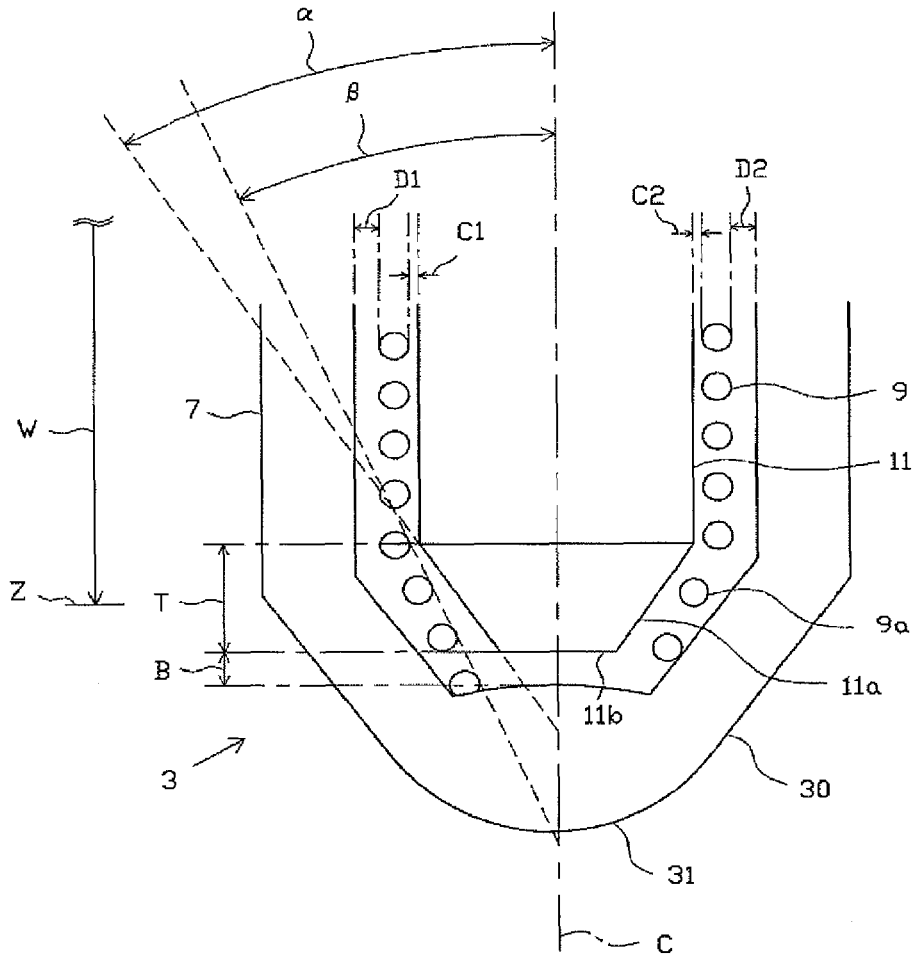
FIG. 3 is a diagram showing a vicinity of a front end portion of the sheath heater.

A configuration of the vicinity of the front end portion of the sheath heater 3, which constitutes a substantial part of the present invention, will next be described in detail with reference to FIG. 3. FIG. 3 is a diagram showing a vicinity of the front end portion of the sheath heater.

A front end taper portion 30 formed at the same time of producing the sheath tube 7 is provided in a circumference of the front end of the sheath tube 7. The front end taper portion 30 serves as a front end reduced diameter portion in this embodiment. Further, a joint portion 31 where the sheath tube 7 and the heating coil 9 are melted is formed on the front end side of the front end taper portion 30.

Further, a taper-shaped reduced diameter portion 9*a* is formed in a circumference of the front end of the heating coil 9. An outermost circumference of the taper-shaped reduced diameter portion 9*a* assumes a taper shape so as to correspond to the shape of the front end taper portion 30 of the sheath tube 7. Further, a front end taper portion 11*a* is formed in a circumference of the front end of the insulator 11 that is inserted into the heating coil 9. An outermost circumference of the front end taper portion 11*a* assumes a taper shape so as to correspond to the shape of the taper-shaped reduced diameter portion 9*a* of the heating coil 9. The front end taper portion 11*a* serves as a thin portion in this embodiment.

A front end portion 11*b* of the insulator 11 is disposed on the front end side of the sheath tube 7 with respect to a front edge position Z in a predetermined section W in the axial C direction where the swaging step is conducted. More particularly, the front end portion 11*b* is disposed so as to satisfy the following expression (1).

$$0 \leqq B \leqq 1 \text{ mm} \quad (1)$$

In this embodiment, a region of the sheath tube 7 from 1 mm rearward with respect to the front end inner face of the sheath tube 7 toward the front end side of the sheath tube 7 is not subjected to the swaging step.

In this embodiment, a taper angle defined by the front end taper portion 11*a* of the insulator 11 and the axis C is larger than a taper angle defined by the taper-shaped reduced diameter portion 9*a* of the heating coil 9 and the axis C. More particularly, a smaller angle defined by the front end taper portion 11*a* of the insulator 11 and the axis C defines a taper angle $\alpha$ for the front end taper portion 11*a*. A smaller angle defined by a tangent line, which connects an inner circumferential portion of the reduced diameter portion 9*a* of the heating coil 9, and the axis C defines a taper angle $\beta$ for the taper-shaped reduced diameter portion 9*a*. In the embodiment shown, the taper angle $\alpha$ is equal to about 20 degrees and the taper angle $\beta$ is equal to about 15 degrees. In this respect, since the front end taper portion 11*a* of the insulator 11 is easily inserted into the taper-shaped reduced diameter portion 9*a* of the heating coil 9, the occurrence of failure can be reduced. An example of a typical failure is where the insulator 11 is incorrectly inserted into the taper-shaped reduced diameter portion 9*a* wherein the front end portion 11*b* of the insulator 11 is caught, i.e., becomes snagged, in the middle of the taper-shaped reduced diameter portion 9*a*, or the like.

Further, a difference Dx between an inner diameter of the general portion of the sheath tube 7 and an outer diameter of the general portion of the heating coil 9—i.e., a sum of clearances D1+D2 between the tube and the coil, defined by an inner circumference of the general portion of the sheath tube 7 and an outer circumference of the general portion of the heating coil 9, satisfies the following expression (2).

$$0.4 \text{ mm} \leqq D1+D2 \leqq 1.1 \text{ mm} \quad (2)$$

When the clearance D1 or D2 between the tube and the coil is too small, the sheath tube 7 and the heating coil 9 are likely to be in contact with each other during the welding or the swaging step due to manufacturing tolerance, resulting in causing short-circuit. When the clearance D1 or D2 between the tube and the coil is too large, the surface temperature of the tube is not likely to rise, resulting in affecting the temperature-rising characteristic of the glow plug.

In addition, a difference Cx between an inner diameter of the general portion of the heating coil 9 and an outer diameter of the general portion of the insulator 11—i.e., a sum of clearances C1+C2 between the coil and the insulator, defined by an inner circumference of the general portion of the heating coil 9 and an outer circumference of the general portion of the insulator 11, satisfies the following expression (3) over the sum of the clearances D1+D2 between the tube and the coil.

$$C1+C2 <= 0.3 \times (D1+D2) \quad (3)$$

The term "general portion" when used in reference to sheath tube 7, heating coil 9 and insulator 11 refers to a portion of said components extending uniformly along the axial C direction, respectively. According to this embodiment, since the outer and the inner diameters of the general portion of the heating coil 9, and the outer and the inner diameters of the general portion of the control coil 10 are the same, the above-expressions are applied to regions where the heating coil 9 and the control coil 10 are positioned.

Further, each distance of the above-mentioned clearance C1, C2, D1, D2 is an actual measurement after the swaging step. Various distances are applicable to the clearance C1, C2, D1, D2 to satisfy the expressions (2) and (3). In this regard, three kinds of Samples each respectively having the sum of the clearance D1+D2 of 1.0 mm, 0.7 mm and 0.4 mm are produced for evaluation. The measurement data of each Sample are shown in Tables 1-3 and FIGS. 4-7.

TABLE 1

| Samples 1: D1 + D2 = 1.0 mm | | | |
|---|---|---|---|
| | C1 + C2 | (C1 + C2)/(D1 + D2) | Minimum Distance of D1 or D2 |
| Sample 1a | 0.42 mm | 0.42 | 0 mm |
| Sample 1b | 0.30 mm | 0.30 | 0.15 mm |
| Sample 1c | 0.24 mm | 0.24 | 0.20 mm |
| Sample 1d | 0.10 mm | 0.10 | 0.32 mm |

In Table 1, four kinds of Samples 1a, 1b, 1c and 1d each having the sum of the clearance D1+D2 of 1.0 mm are shown. Each Sample 1a, 1b, 1c and 1d has the sum of the clearance C1+C2 of 0.42 mm, 0.30 mm, 0.24 mm, and 0.10 mm, respectively. Here, the sample 1a is a comparative sample, and other samples 1b, 1c and 1d are formed according to this embodiment.

Figure 4:
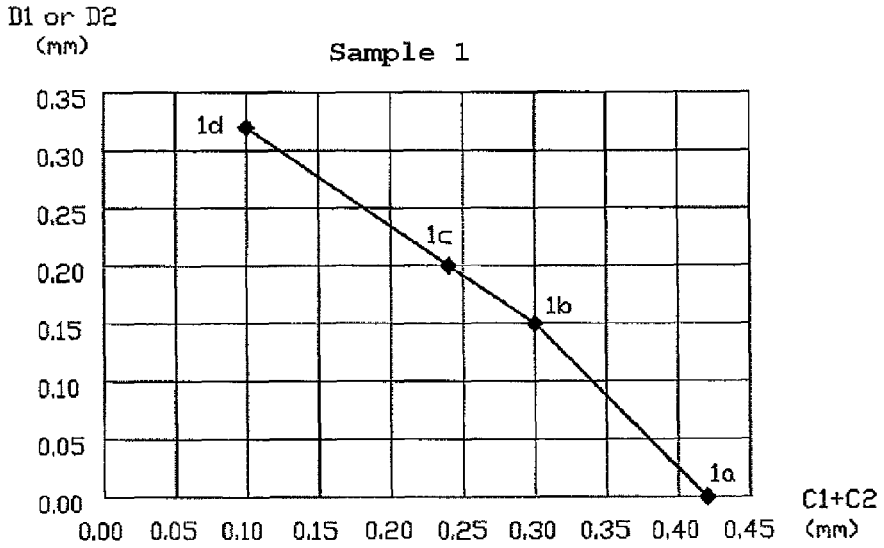
FIG. 4 is a graph showing measurement data of samples.

In Table 1, the ratio of the sum of the clearance C1+C2 to the sum of the clearance D1+D2 in each Sample 1a told are shown. In this evaluation, 100 pieces of each Sample 1a to 1d were produced. The minimum distance of the clearance D1 or D2 measured in 100 pieces is stated in Table 1. Each minimum distance of the clearance D1 or D2 was 0 mm in Sample 1a, 0.15 mm in Sample 1b, 0.20 mm in Sample 1c and 0.32 mm in Sample 1d. FIG. 4 is a graph showing a relationship between the sum of the clearance C1+C2 shown in Table 1 and the minimum distance of the clearance D1 or D2. Here, the sum of the clearance C1+C2 is expressed in a horizontal axis and the minimum distance of the clearance D1 or D2 is expressed in a vertical axis.

TABLE 2

| Sample 2: D1 + D2 = 0.7 mm | | | |
|---|---|---|---|
| | C1 + C2 | (C1 + C2)/ (D1 + D2) | Minimum Distance of D1 or D2 |
| Sample 2a | 0.31 mm | 0.44 | 0 mm |
| Sample 2b | 0.20 mm | 0.29 | 0.13 mm |
| Sample 2c | 0.13 mm | 0.19 | 0.22 mm |
| Sample 2d | 0.05 mm | 0.07 | 0.32 mm |

In Table 2, four kinds of Samples 2a, 2b, 2c and 2d each having the sum of the clearance D1+D2 of 0.7 mm are shown. Each Sample 2a, 2b, 2c and 2d has the sum of the clearance C1+C2 of 0.31 mm, 0.20 mm, 0.13 mm, and 0.05 mm, respectively. Here, the sample 2a is a comparative sample, and other samples 2b, 2c and 2d are formed according to this embodiment.

Figure 5:
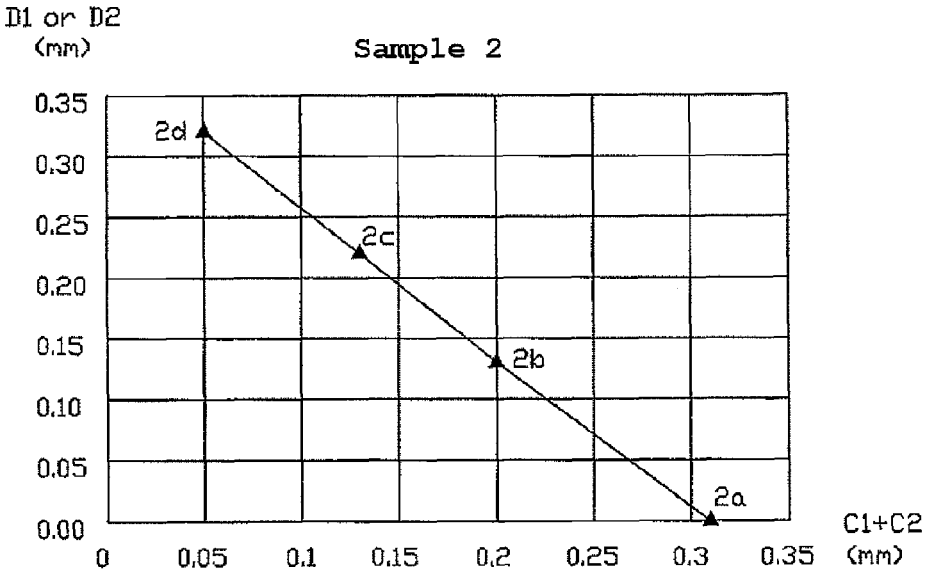
FIG. 5 is a graph showing measurement data of samples.

Similar to Table 1, the ratio of the sum of the clearance C1+C2 to the sum of the clearance D1+D2 in each Sample 2a to 2d, and the minimum distance of the clearance D1 or D2 are stated in Table 2. Each minimum distance of the clearance D1 or D2 was 0 mm in Sample 2a, 0.13 mm in Sample 2b, 0.22 mm in Sample 2c and 0.32 mm in Sample 2d. Similar to FIG. 4, FIG. 5 is a graph showing a relationship between the sum of the clearance C1+C2 and the minimum distance of the clearance D1 or D2 shown in Table 2.

TABLE 3

| Sample 3: D1 + D2 = 0.4 mm | | | |
|---|---|---|---|
| | C1 + C2 | (C1 + C2)/ (D1 + D2) | Minimum Distance of D1 or D2 |
| Sample 3a | 0.18 mm | 0.45 | 0 mm |
| Sample 3b | 0.11 mm | 0.28 | 0.17 mm |
| Sample 3c | 0.08 mm | 0.20 | 0.22 mm |
| Sample 3d | 0.04 mm | 0.10 | 0.31 mm |

In Table 3, four kinds of Samples 3a, 3b, 3c and 3d each having the sum of the clearance D1+D2 of 0.4 mm are shown. Each Sample 3a, 3b, 3c and 3d has the sum of the clearance C1+C2 of 0.18 mm, 0.11 mm, 0.08 mm, and 0.04 mm, respectively. Here, the sample 3a is a comparative sample, and other samples 3b, 3c and 3d are formed according to this embodiment.

Similar to Table 1, the ratio of the sum of the clearance C1+C2 to the sum of the clearance D1+D2 in each Sample 3a to 3d, and the minimum distance of the clearance D1 or D2, are stated in Table 3. Each minimum distance of the clearance D1 or D2 was 0 mm in Sample 3a, 0.17 mm in Sample 3b, 0.22 mm in Sample 3c and 0.31 mm in Sample 3d. Similar to FIG. 4, FIG. 6 is a graph showing a relationship between the sum of the clearance C1+C2 and the minimum distance of the clearance D1 or D2 shown in Table 3.

Figure 6:
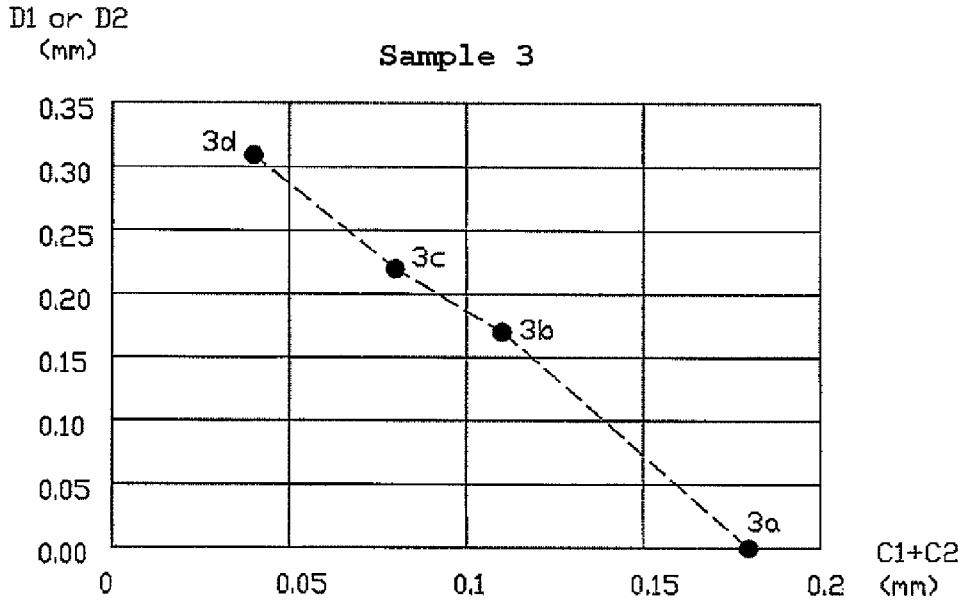
FIG. 6 is a graph showing measurement data of samples.
Figure 7:
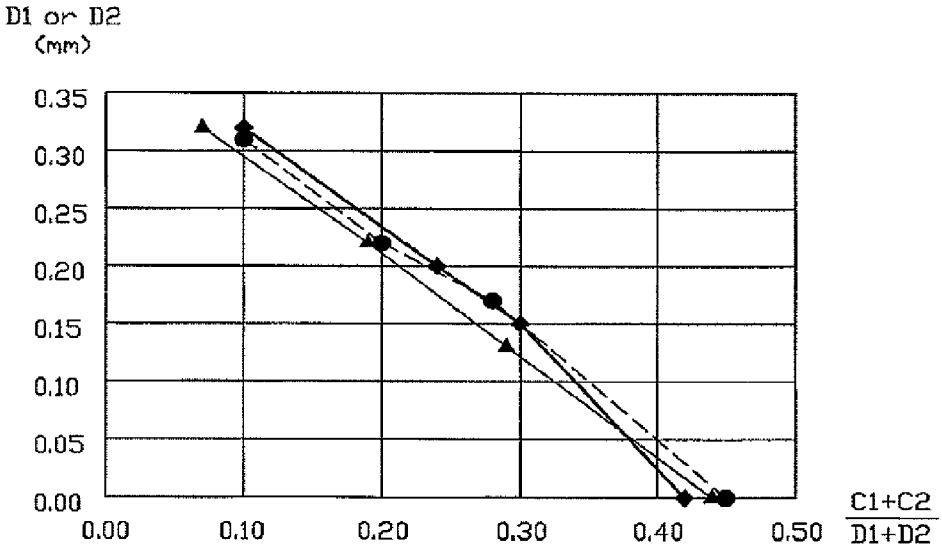
FIG. 7 is a graph showing measurement data of samples.

FIG. 7 is a graph combining the graphs in FIGS. 4 to 6. It is apparent from FIG. 7 that the minimum distance of the clearance D1 or D2 tends to be small as the ratio of the sum of the clearance C1+C2 to the sum of the clearance D1+D2 becomes large. In particular, Samples 1a, 2a and 3a, all of which have the ratio larger than 0.4, had the minimum distance of the clearance D1 or D2 of 0 mm. The minimum distance 0 mm means that the inner circumference of the general portion of the sheath tube 7 is attached to the outer circumference of the general portion of the heating coil 9 or that of the control coil 10. Thus, a short-circuit failure occurs when the electric power is supplied to a sample. Therefore, when a product similar to Sample 1a, 2a or 3a is actually manufactured, it tends to cause a short-circuit failure, resulting in lowering the manufacturing yield. On the other hand, in other Samples having the ratio of 0.3 or less, there was no sample in 100 pieces that exhibited the minimum distance of the clearance D1 or D2 of 0 mm. Therefore, a sufficient manufacturing yield can be obtained as long as a product satisfies the above expression (3) after the swaging step.

Next, in order to verify the effects of the present invention, an evaluation of the sheath heater 3 was conducted. The results are shown in Table 4. In this evaluation, a short-circuit failure, deformation of the front end of the coil, temperature-rising characteristic and durability of the heater were verified.

TABLE 4

| | Distance B (mm) | Insulator Ave. Diameter (mm) | Taper Portion | Short-Circuit Failure | Deformation of Coil Front End | Ave. Temperature Rising Characteristic | Durability (cycles) |
|---|---|---|---|---|---|---|---|
| Comparative | 1 | ϕ1.4 | no | yes | Δ | 850 ± 50? | 6000 |
| Comparative | 2 | ϕ1.8 | no | no | X | 850 ± 40? | 3000 |
| Example 1 | 0 | ϕ1.8 | yes | no | ○ | 850 ± 30? | 6000 |
| Example 2 | 1 | ϕ1.8 | yes | no | ○ | 850 ± 30? | 6000 |

The evaluation results of the sheath heaters 3 (Examples 1 and 2) and sheath heaters (Comparative samples 1 and 2) are shown in Table 4. The sheath heaters 3 (Examples 1 and 2) included the insulator 11 with the average outer diameter of 1.8 mm, respectively, in the general portion thereof after the swaging step and had at least one end assuming a different shape from another end. The sheath heaters (Comparative samples 1 and 2) included the insulator 11 with the average outer diameter of 1.4 mm and 1.8 mm, respectively, in the general portion thereof. The results are based on measurements of 100 pieces in each Example 1, Example 2, Comparative sample 1 and Comparative sample 2. In the evaluation on an average temperature-rising characteristic and durability, the average value, variation and the number of the shortest cycles were obtained, except for the examples having a short-circuit failure.

In the evaluation on a short-circuit failure, an X-ray photo of each example was used for measuring a clearance, verifying whether or not the inner circumferential portion of the general portion of the sheath tube 7 was in contact with the outer circumferential portion of the general portion of either the heating coil 9 or the control coil 10. Further, a current value after energizing an example was checked to confirm a short-circuit failure.

The evaluation on deformation of the front end of the coil also used an X-ray photo of each example, verifying deformation in the vicinity of the front end portion of the heating coil 9 of each sample. Here, "○" represents that there was no deformation in the examples. "Δ" represents that there was some deformation in the examples. "×" represents that there was great deformation in the examples.

In the evaluation on the temperature-rising characteristic, constant voltage with direct current at 24V was applied to each sample so as to measure the temperature of the heater at 6 seconds after energization. The average temperature-rising and its variation were studied.

In the durability evaluation, the direct current at 26V was applied to each example for 30 seconds, and thereafter, the electric power supply was halted until the surface temperature of the tube reached 50 degrees C. or less. This cycle was repeated in the durability test. The shortest number of cycles in each example having a failure, such as disconnection, was obtained.

Figure 9:
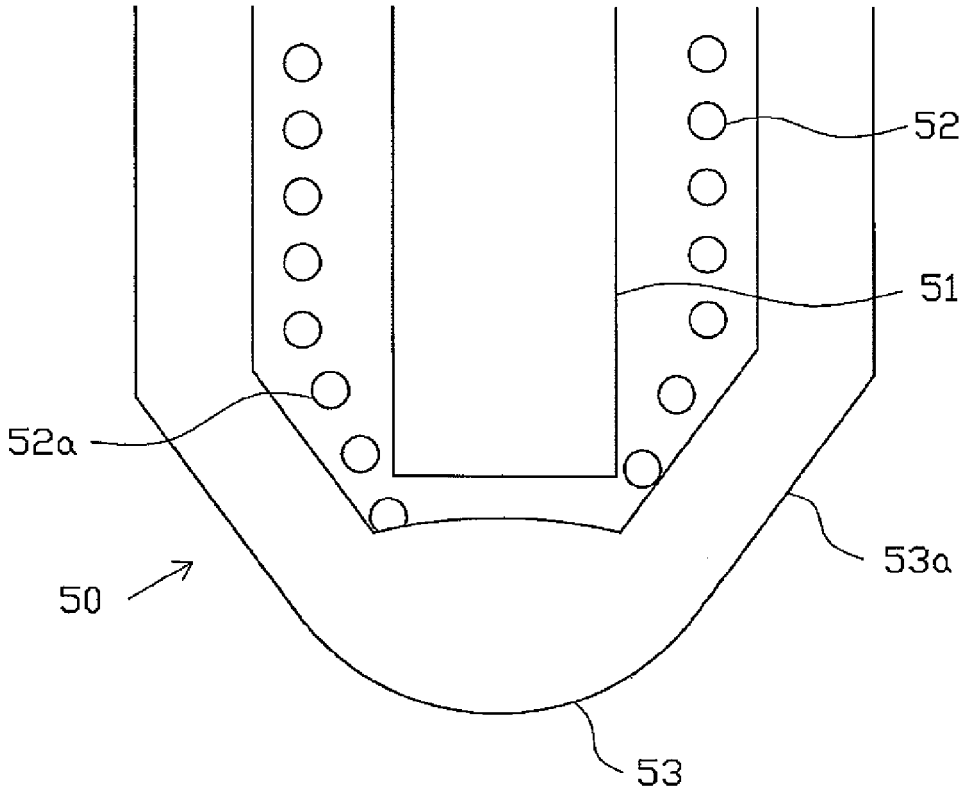
FIG. 9 is a diagram showing a vicinity of a front end portion of a conventional sheath heater.

As shown in Table 4, some short-circuit failures were found in Comparative samples 1 which had the insulator 11 with the average outer diameter of 1.4 mm in the general portion thereof after the swaging step. These failures were caused by the heating coil 9 and the control coil 10 that were bent or eccentric due to the swaging step. Since the insulator 11 had a relatively thin outer diameter compared to that of the general portion of the heating coil 9 or the control coil 10, the clearances C1, C2 became large. However, only some pieces in Comparative samples 1 exhibited a slight inconsistent deformation in the vicinity of the front end portion of the heating coil 9. This is because the outer diameter of the insulator 11 was so small that the front end thereof could reach the front end side of the taper-shaped reduced diameter portion 9*a* of the heating coil 9 (refer to FIG. 9), whereby a distance B between the front end inner face of the sheath tube 7 and the front end portion 11*b* of the insulator 11 was as short as 1 mm. As a result, an impact of the swaging step on the vicinity of the front end portion of the heating coil was reduced. The number of cycles where the disconnection or the like occurred in Comparative samples 1 was 6000 cycles, showing an excellent durability. However, since some Comparative samples 1 had short-circuit failure and inconsistent deformations of the heating coil 9 and the control coil 10 in the swaging step, the temperature-rising characteristic of the heater measured at 6 seconds after energization was an average of 850° C.±50° C., showing the greatest variation among three other Examples.

Figure 10:
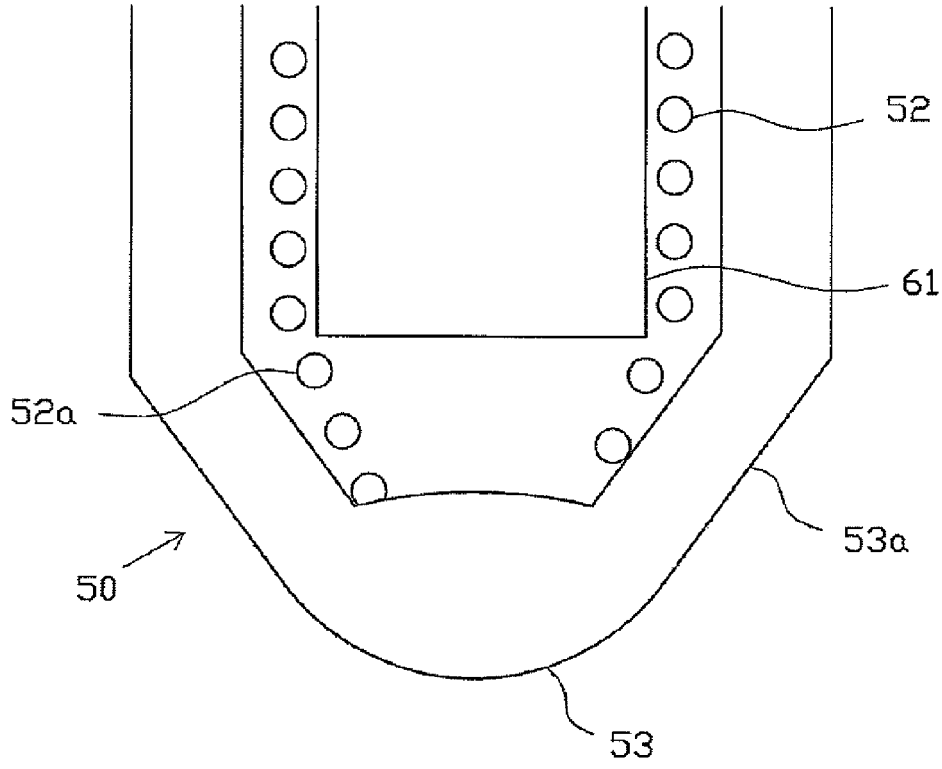
FIG. 10 is a diagram showing a vicinity of a front end portion of a conventional sheath heater.

On the other hand, in Comparative samples 2 where the average outer diameter of the general portion of the insulator 11 was 1.8 mm after the swaging step, the outer diameter of the insulator 11 was relatively large compared to that of the general portion of the heating coil 9 or that of the control coil 10, and also the clearances C1 and C2 were small. Thus, none of Comparative samples 2 exhibited the heating coil 9 or the control coil 10 having a large bend or the eccentricity due to the swaging step, whereby short-circuit failure was not observed. The temperature-rising characteristic of the heater measured at 6 seconds after energization was an average of 850° C.±40° C., showing a relatively small variation compared to the case of Comparative samples 1. However, since the front end of the insulator 11 did not reach the front end side of the taper-shaped reduced diameter portion 9*a* of the heating coil 9 in Comparative samples 2 (refer to FIG. 10), the distance B between the front end inner face of the sheath tube 7 and the front end portion 11*b* of the insulator 11 was as large as 2 mm. Some pieces of Comparative samples 2 exhibited great deformation in the vicinity of the front end portion of the heating coil 9 after the swaging step. Since Comparative samples 2 had a variation in thickness in a portion that was inconsistently deformed and had large resistance in a thin portion thereof, disconnection at an early stage occurred. The result of durability evaluation of Comparative sample 2 was 3000 cycles, showing the worst durability among three other Examples.

In Examples 1 and 2 according to the present invention, since the front end taper portion 11*a* is formed at the front end of the insulator 11, the front end of the insulator 11 can reach the front end side of the taper-shaped reduced diameter portion 9*a* of the heating coil 9, while maintaining the clearances C1 and C2 relatively small. In Examples 1 and 2, since the clearance between the outer circumferential portion of the front end taper portion 11*a* of the insulator 11 and the inner circumferential portion of the taper-shaped reduced diameter portion 9*a* of the heating coil 9 can be made smaller, an impact of the swaging step on a vicinity of the front end portion of the heating coil 9 was more effectively reduced compared to the case of Comparative sample 1. Thus, none of Examples 1 and 2 exhibited an inconsistent deformation in the vicinity of the front end portion of the heating coil 9. Similar to Comparative sample 1, durability of Examples 1 and 2 was 6000 cycles, respectively, and the distance B between the front end inner face of the sheath tube 7 and the front end portion 11*b* of the insulator 11 was 0 mm in Example 1, and 1 mm in Example 2. These results showed the excellent durability of Examples 1 and 2. Further, similar to Comparative sample 2, none of Examples 1, 2 exhibited a large bend or eccentricity in the heating coil 9 or the control coil 10, whereby short-circuit failure was not observed. In addition, since the heating coil 9 of Examples 1 and 2 was likely to be uniformly deformed, the temperature-rising characteristic of the heater measured at 6 seconds after energization was an average of 850° C.±30° C., showing the smallest variation among three other Examples.

Next, Table 5 shows the verification result on a relationship between the distance B and a performance of the sheath heater 3. In this verification, the amount of modification and the durability of the front end of the coil were studied using the same method as the above.

TABLE 5

| | Distance B (mm) | Insulator Ave. Outer Dia. (mm) | Deformation of Coil Front End | Durability (cycles) |
|---|---|---|---|---|
| Example 3 | 0.00 | ϕ1.8 | ? | 6000 |
| Example 4 | 0.50 | ϕ1.8 | ? | 6000 |
| Example 5 | 0.75 | ϕ1.8 | ? | 6000 |
| Example 6 | 1.00 | ϕ1.8 | ? | 6000 |
| Comparative Sample 3 | 1.25 | ϕ1.8 | X | 4000 |
| Comparative Sample 4 | 1.50 | ϕ1.8 | X | 3000 |
| Comparative Sample 5 | 2.00 | ϕ1.8 | X | 3000 |

Table 5 shows the evaluation results of each embodiment (Examples 3-6 and Comparative samples 3-5). Each embodiment had a sheath heater 3 having the insulator 11 with the average outer diameter of 1.8 mm in the general portion thereof after the swaging step. Each embodiment had a different distance B between the front end inner face of the sheath tube 7 and the front end portion 11*b* of the insulator 11 by altering a length T (referring to FIG. 3) in the axial C direction of the front end taper portion 11*a* of the insulator 11. These results were based on the measurement of 20 pieces in each Example and Comparative sample. Comparative samples 5 (B=2.00 mm) had the length T of 0 mm, i.e., there was substantially no front end taper portion 11*a*.

As shown in Table 5, Examples having the distance B of 0 mm (Example 3), 0.50 mm (Example 4), 0.75 mm (Example 5) and 1.00 mm (Example 6) and satisfying the above expression (1) did not show any inconsistent deformation in the vicinity of the front end portion of the heating coil 9. Thus, in the durability test on Example 3 to 6, the number of cycles where the disconnection or the like occurred was 6000 cycles, showing an excellent durability.

On the other hand, similar to the structure where the front end taper portion 11*a* was not formed at the front end of the insulator 11, in Comparative samples 3, 4, 5 having the distance B of 1.25 mm, 1.50 mm and 2.00 mm, respectively, and not satisfying the above expression (1), some samples exhibited a large amount of deformation in the vicinity of the front end portion of the heating coil 9 after the swaging step. Thus, the results of the durability test were 4000 cycles in Comparative sample 3 and 3000 cycles in Comparative samples 4 and 5, which were worse than the results of the Examples 3 to 6.

In order to reduce the short-circuit between the tube and the coil, it is apparent from the above results that the heating coil 9 or the control coil 10 can be prevented from being bent and eccentric by making the insulator 11 thick. Further, in order to reduce inconsistent deformation in the vicinity of the front end portion of the heating coil 9, the front end of the insulator 11 is made to reach the front end side of the taper-shaped reduced diameter portion 9*a* of the heating coil 9 to thereby reduce the amount of deformation in the vicinity of the front end portion of the heating coil during the swaging step. That is, in order to materialize both advantages, the insulator 11 should be relatively thick and have the front end taper portion 11*a* at the front end thereof so as to reach the front end side of the taper-shaped reduced diameter portion 9*a* of the heating coil 9. In this way, the durability of the glow plug 1 can be improved, and it is possible to control the variation in temperature-rising characteristic of the heater. Even when the insulator 11 is broken in pieces within the sheath tube 7 in the swaging step, the insulator 11 still remains in the heating coil 9 and the control coil 10 in the swaging step, thereby minimizing the impact on the heating coil 9 or the like.

According to the result of Comparative samples 1, although a clearance is formed between the insulator 11 and the taper-shaped reduced diameter portion 9*a* of the heating coil 9 because the insulator 11 has a relatively thin outer diameter, the front end of the insulator 11 can reach front end side of the taper-shaped reduced diameter portion 9*a* of the heating coil 9. Thus, as long as the distance B between the front end inner face of the sheath tube 7 and the front end portion 11*b* of the insulator 11 is 1 mm or less ($B \leqq 1$ mm), the durability of the glow plug 1 is unlikely to be affected. Similarly, according to the results shown in Table 5, although the length T of the front end taper portion 11*a* varies, the durability of the glow plug 1 is unlikely to be affected, as long as the distance B between the front end inner face of the sheath tube 7 and the front end portion 11*b* of the insulator 11 is 1 mm or less ($B \leqq 1$ mm).

The present invention is not limited to the above-described embodiments, it may, for example, carry out as follows.

(a) Each composition of the glow plug 1, such as a shape, is not limited to the above-mentioned embodiment. For example, the sheath tube 7 may have a generally uniform outer diameter without the large diameter portion 7*b*. Although the heating coil 9 and the control coil 10 are described together as the coil member in the above-mentioned embodiments, the coil member may have no control coil 10.

Further, the method for manufacturing the glow plug 1 is not limited to the above-mentioned embodiments. For example, the swaging step is generally conducted in a regular direction, i.e., from the front end side to the rear end side of the sheath tube 7, or in a reverse direction, i.e., from the rear end side to the front end side of the sheath tube 7. However, the swaging direction is not limited to the above embodiments. The swaging step may be conducted in both directions, or may be selected from either the regular direction or the reverse direction.

(b) The dimensions of the sheath tube 7, the heating coil 9, the control coil 10 and the insulator 11 may be any kind of combination, as long as they satisfy the above-mentioned expressions (2) and (3).

Figure 8:
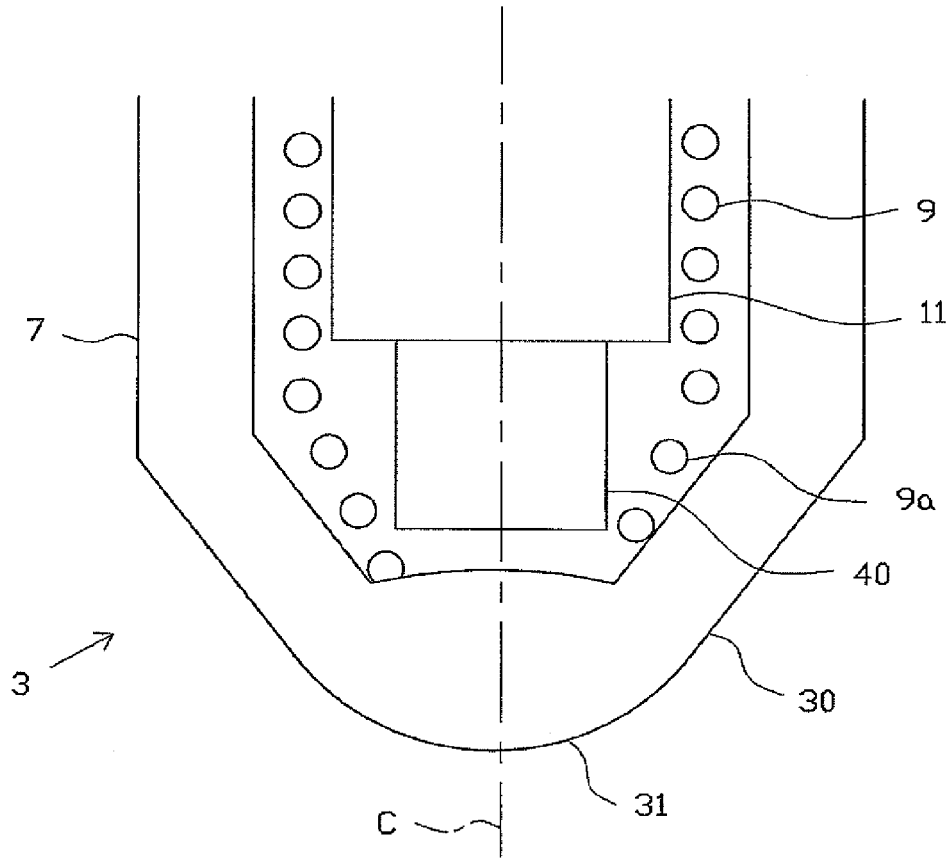
FIG. 8 is a diagram showing a vicinity of a front end portion of the sheath heater according to another embodiment.

(c) Further, the shape of the insulator 11 is not limited to the above-mentioned embodiments. For example, instead of forming the front end taper portion 11*a* on the front end side of the insulator 11, a thin diameter portion 40 having a uniform outer diameter smaller than the general portion of the insulator 11 and extending in the axis C direction may be formed as shown in FIG. 8. In this configuration, the same effects as in the above-mentioned embodiments can also be obtained. However, it is more preferable that the front end of the insulator 11 be formed in a taper shape so as to reduce the clearance with the inner circumferential portion of the taper-shaped reduced diameter portion 9*a* of the heating coil 9.

Although only the front end side of the insulator 11 has the taper shape in the above-mentioned embodiment, the rear end side of the insulator 11 may also have the same taper portion as the front end taper portion 11*a*. In this case, since the insulator 11 has the same taper portion at both ends thereof, a process to confirm the insertion direction of the taper portion 11*a* of the insulator 11 may be omitted, when inserting the insulator 11 into the heating coil 9 and the control coil 10. As a result, workability in the manufacturing process can be improved.

Furthermore, in the above-mentioned embodiment, the taper angle $\alpha$ of the taper portion 11*a* of the insulator 11 is set to be 20 degrees, and the taper angle $\beta$ of the front end side taper-shaped reduced diameter portion 9*a* of the heating coil 9 is set to be 15 degrees. However, the taper angle $\alpha$ may be greater or equal to the taper angle $\beta$. When there is a large gap between the taper angles $\alpha$ and $\beta$, it is difficult to obtain the above mentioned effect that reduces the impact of the swaging step. Thus, it is preferable to satisfy the following relation (4).

$$\beta \leqq \alpha\beta + 10 \text{ degrees} \quad (4)$$

In order to reduce the clearance with the inner circumferential portion of taper-shaped reduced diameter portion 9*a* of the heating coil 9, it is preferable that both taper angles be the same ($\alpha = \beta$).

(d) The material of the insulator 11 is not limited to the above-mentioned embodiment, and the insulator 11 may be made of other insulating materials, such as, by way of example and not limitation, magnesium oxide.

(e) Although the outer diameters and the inner diameters of the general portions of the heating coil and the control coil 10 are the same in the above-mentioned embodiments, they may vary. Further, another example of enhancing effects of the present invention is that a general portion of the control coil and the heating coil may be made of a material that can be easily deformed (e.g., a material having a low Young's module).

The invention claimed is:

1. A glow plug, comprising:

an axially extending cylindrical sheath tube including a closed front end;

a coil made of a resistance wire having a taper-shaped reduced diameter portion formed at one end thereof, said coil disposed within said sheath tube and extending along the axis of the sheath tube with said taper-shaped reduced diameter portion joined to a front end of the sheath tube;

a rod-like insulator made of an insulating material indisposed within the coil, said insulator having a general portion, a thin portion having a diameter smaller than an outer diameter of said general portion and a front end face, said thin portion formed on a front end side of the insulator, and being disposed within said taper-shaped reduced diameter portion of the coil, and insulating powder disposed within the sheath tube, said sheath tube being swaged along a portion of the axial length thereof, and said front end surface of the insulator being disposed at a position in the axial direction beyond where the swaging of said sheath tube occurred.

2. The glow plug according to claim 1, wherein the glow plug satisfies an expression:

$$0 \leqq B \leqq 1 \text{ mm},$$

where "B" is a distance between a front end inner face of the sheath tube and a front end portion of the insulator in an axial direction.

3. The glow plug according to claim 1 or 2, wherein the glow plug satisfies an expression:

$$0.4 \text{ mm} \leqq Dx \leqq 1.1 \text{ mm},$$

where Dx is a difference between an inner diameter of the general portion of the sheath tube and an outer diameter of the general portion of the coil, and the glow plug further satisfies an expression:

$$Cx \leqq 0.3 \times Dx,$$

where Cx is a difference between the inner diameter of the general portion of the coil and the outer diameter of the general portion of the insulator.

4. The glow plug according to claim 1, wherein the thin portion of the insulator assumes a taper shape toward the front end portion of the insulator.

5. The glow plug according to claim 4 satisfies an expression:

$$\beta < \alpha,$$

where $\alpha$ is a smaller angle in angles defined by the outer circumferential portion of the taper portion of the insulator and the axis, and where a smaller angle in angles defined by a tangent line, which connects an inner circumferential portion of the taper-shaped reduced diameter portion of the coil, and the axis serves as a taper angle "$\beta$".

6. The glow plug according to claim 1, wherein another thin portion having a diameter equal to the thin portion at the front end side is formed at a rear end side of the insulator.

7. A method for manufacturing a glow plug, comprising:

disposing a coil made of a resistance wire along an axis of a cylindrical sheath tube that extends in an axial direction, said coil having a taper-shaped reduced diameter portion formed in a vicinity of the front end of the coil;

joining a front end of the coil to a front end portion of the sheath tube while closing the front end of the sheath tube;

inserting a rod-like insulator made of an insulating material into the coil, said insulator having a thin portion, which is formed on the front end side of the insulator, said thin portion having a diameter smaller than an outer diameter of a general portion of the insulator, said thin portion of said insulator being inserted in said taper-shaped reduced diameter portion formed in a vicinity of the front end of the coil;

filling the sheath tube with an insulating powder; and swaging the sheath tube, wherein, during the swaging step, a front end surface of the insulator is disposed at or beyond a front edge position on said sheath tube in the axial direction where the swaging step is conducted.

* * * * *